United States Patent [19]

Ootsuka

[11] Patent Number: 5,059,930

[45] Date of Patent: Oct. 22, 1991

[54] ELECTROMAGNETIC CONTACTOR AND FABRICATION METHOD THEREFOR

[75] Inventor: Shigeharu Ootsuka, Nagoya, Japan

[73] Assignee: Mitsubishi Denki Kabushiki Kaisha, Tokyo, Japan

[21] Appl. No.: 497,615

[22] Filed: Mar. 23, 1990

[30] Foreign Application Priority Data

Mar. 29, 1989 [JP] Japan ..... 1-76989

[51] Int. Cl.[5] ..... H01H 67/02

[52] U.S. Cl. ..... 335/131; 335/132

[58] Field of Search ..... 335/106, 126, 131, 132, 335/202

[56] References Cited

U.S. PATENT DOCUMENTS

| | | | |
|---|---|---|---|
| 3,117,294 | 1/1964 | Muszynski | 335/132 |
| 3,671,891 | 6/1972 | Usui et al. | 335/126 |
| 3,872,580 | 3/1975 | Fisher et al. | 335/299 |

FOREIGN PATENT DOCUMENTS 59-119541 8/1984 Japan .

*Primary Examiner*—Gerald P. Tolin
*Assistant Examiner*—Lincoln Donovan
*Attorney, Agent, or Firm*—Burns, Doane, Swecker & Mathis

[57] ABSTRACT

In an electromagnetic contactor, a coil spool (5) in which a coil (5A) is wound and a movable iron core (4) is movably mounted, a cover (20) in which a crossbar (10) having a movable contact (15) is slidably mounted, and a mechanical link (6) which makes a mechanical linkage of the movable iron core (4) with the crossbar (10) are arranged such that the positioning between the coil spool (5) and the cover (20) is defined by making contact of an engaging member (60) of the cover (20) with the coil spool (5); and the coil spool (5) is relatively pushed to the engaging member (60) from a coil terminal (25) fixed in the cover (20) by means of an elastic force of a contact terminal (35) which is provided in the coil spool (5) and makes electrical connection between the coil (5A) and the coil terminal (25).

8 Claims, 9 Drawing Sheets

ELECTROMAGNETIC CONTACTOR AND FABRICATION METHOD THEREFOR

FIELD OF THE INVENTION AND RELATED ART STATEMENT

1. Field of the Invention

The present invention relates to an electromagnetic contactor and more particularly to an improvement to reduce an integrated fabrication error in assembling of components.

2. Description of the Related Art

FIG. 6 is a cross-sectional view showing a conventional electromagnetic contactor disclosed in the Japanese unexamined patent application (TOKKAI) Sho 63-79304. This electromagnetic contactor includes a polarized electromagnet. In FIG. 6, a channel-shaped fixed iron core 101, an L-shaped magnetic pole sheet 102 and a coil spool 105 on which a coil 105A is wound are fixedly mounted to a case 130 to constitute an electromagnet. An H-shaped movable iron core 104 is movably mounted to the case 130 in the right and left direction of the figure. A right end of the movable iron core 104 is engaged with a link 106 via a linkage pin 108. The link 106 is made of molded resin etc. and is pivotally mounted to the case 130 around a fulcrum pin 107. A pair of spacers 109*a* and 109*b* are provided in order to adjust both a stroke of the movable iron core 104 and attraction force between the movable iron core 104 and the fixed iron core 101, by selection of their thicknesses. The above-mentioned parts constitute an electromagnet part A within the case 130. A crossbar 110 is engaged with the link 106 and makes sliding action to carry movable contacts (not shown), which are mounted on the crossbar 110, toward fixed contact (not shown). The crossbar 110 with the movable contacts held thereon and the fixed contacts, which form a contact part B, are mounted within a cover 120. The cover 120 couples with the case 130 by a mechanical coupling, thereby forming an exterior part of the electromagnetic contactor. The contact part B is isolated from the electromagnet part A by a shielding sheet 140 made of a flat insulation board e.g. of a synthetic resin. The crossbar 110 is urged from the cover 120 to move rightward by a compression spring 150. More specifically, the fulcrum pin 107 is inserted into a hole (not shown) formed in an illustration-omitted part of the coil spool 105, and the fixed iron core 101 and the magnetic pole sheet 102 are fixed in grooves (not shown) formed in the coil spool 105. Since the coil spool 105 is fixedly positioned by a pair of projections 111, the electromagnet part A is fixed to the case 130.

Next, operation of the above-mentioned conventional electromagnetic contactor is described. A state shown by FIG. 6 is a released state of the electromagnetic contactor. When the coil 105A is excited from the released state, the movable iron core 104 is attracted to the fixed iron core 101 in a direction shown by an arrow X. The crossbar 110 is thereby pushed leftward via the link 106 and makes sliding motion in a direction shown by an arrow Y. At that time, the movable contacts make contact with the fixed contacts, thereby electrically making contact. When excitation of the coil 105A is lost, the crossbar 110 is pushed rightward owing to an expansion force of the compression spring 150 and returns to the released state. At that time, the movable contacts detach from the fixed contacts, thereby electrically breaking contact. In breaking contact, arcs are generated between the fixed contacts and the movable contacts.

In the above-mentioned electromagnetic contactor, positions of the fixed contacts, the electromagnet part A and the crossbar 110 are determined in relative positional relation to the cover 120, the case 130 and the link 106, respectively. When the cover 110 makes a loose-coupling with the case 130 or makes an inaccurate-coupling with the case 130, normal positional relation between the electromagnet part A and the contact part B is not guaranteed because of an integrated error of the components. As a result, a contact gap or a contact lap amount is not kept accurate as designed.

OBJECT AND SUMMARY OF THE INVENTION

An object of the present invention is to offer an electromagnetic contactor in which the contact gap or the contact lap amount is not influenced by the integrated error of the components in an assembly.

In order to achieve the above-mentioned object, the electromagnetic contactor of the present invention comprises:

a coil spool in which a movable iron core is movably mounted and a coil is wound;

a cover in which a fixed contact is fixedly mounted and a crossbar having a movable contact is slidably mounted;

a mechanical link which is pivotally held by the coil spool and makes a mechanical linkage of the movable iron core with said crossbar;

an engaging member which is fixedly provided with the cover to perpendicularly dispose to a sliding direction of the crossbar, the engaging member being engaged with the coil spool;

a coil terminal which is fixedly mounted in the cover and reaches the coil spool at an end part thereof; and a contact terminal which has an elastic portion for pushing the coil spool to the engaging member from the end part of the coil terminal by making contact with the end part and is connected to the coil.

In an aspect of a method for fabricating the electromagnetic contactor, the present invention comprises:

a first step of mounting a coil spool in a case, the coil spool having a coil wound therein, a movable iron core movably mounted therein and a link pivotally held therein;

a second step of slidably mounting a crossbar in a cover and fixing a coil terminal in the cover, the coil terminal reaching the coil spool;

a third step of engaging the coil spool with a reference surface which is perpendicularly provided to a moving direction of the crossbar at the time when the cover is coupled with the case;

a fourth step of making contact of the coil terminal with an elastic portion of a contact terminal which is electrically connected to the coil, to give an elastic force between the coil spool and the coil terminal, and a fifth step of pushingly making contact of the coil spool with the reference surface to position the coil spool before coupling of the cover with the case.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

Hereafter, a preferred embodiment of the present invention is described with reference to the accompanying drawings.

Figure 1:
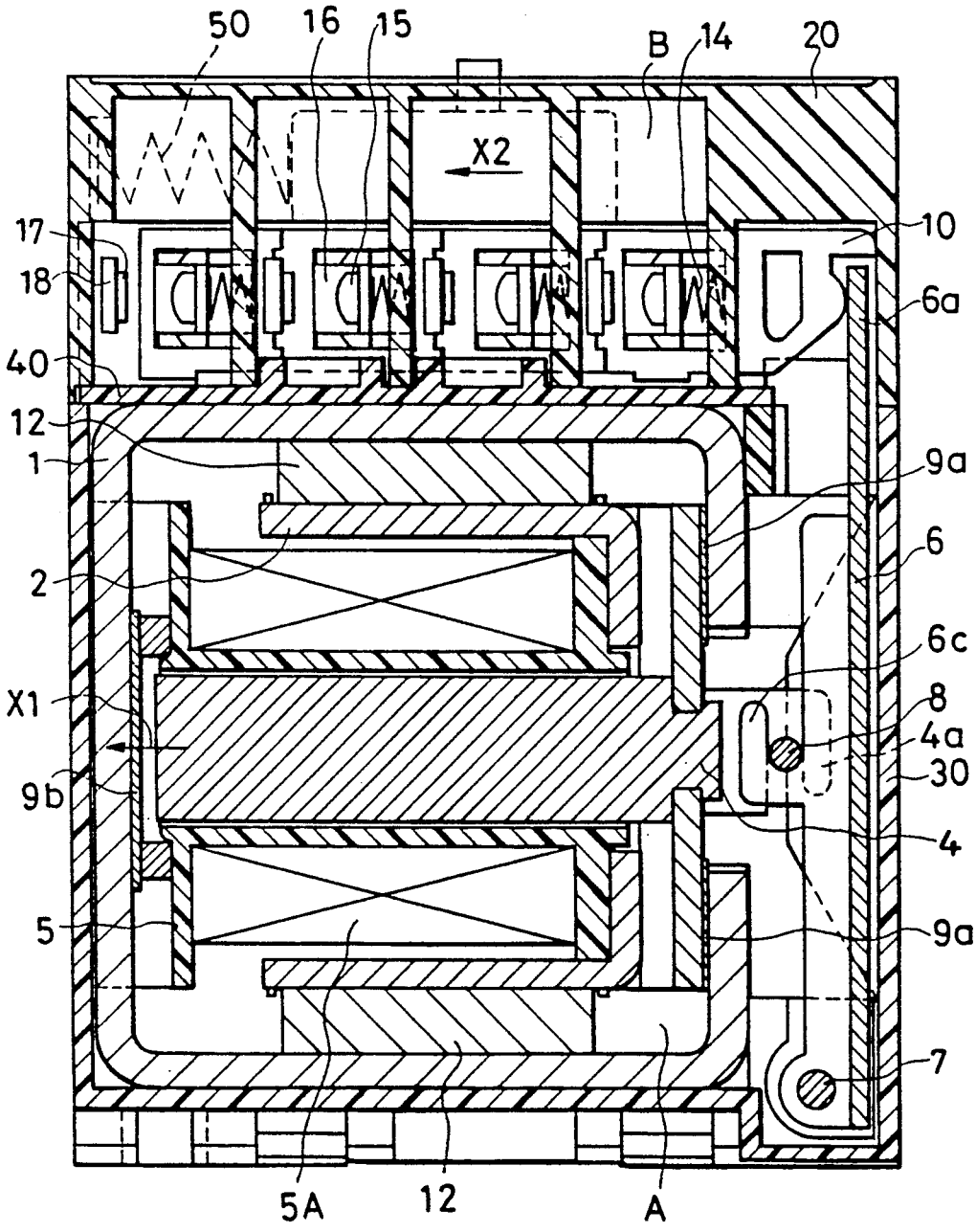
FIG. 1 is a cross-sectional view showing an electromagnetic contactor of the present invention.

FIG. 1 is a cross-sectional view showing an electromagnetic contactor of the present invention. In FIG. 1, a channel-shaped fixed iron core 1, L-shaped magnetic pole sheets 2 and a coil spool 5 on which a coil 5A is wound are fixedly mounted to a case 30 to constitute an electromagnet. Permanent magnets 12 are provided between the fixed iron core 1 and the magnetic pole sheets 2 in order to assist the attraction by the electromagnet to thereby lighten a burden of the coil 5A. These permanent magnets 12 also improve a performance to withstand the mechanical shock from the outside. A T-shaped movable iron core 4 is movably mounted to the case 30 in the right and left direction of the figure. A right end of the movable iron core 4 is engaged with a link 6 via a linkage pin 8. The link 6 is made of a metal sheet and is pivotally mounted to the case 30 around a fulcrum pin 7. Spacers 9*a* and 9*b* are provided in order to adjust attraction force between the movable iron core 4 and the fixed iron core 1. The above-mentioned parts constitute an electromagnet part A within the case 30. A crossbar 10 is engaged with the link 6 and makes sliding action to carry plural pairs of movable contacts 15 toward plural pairs of fixed contacts 17, respectively. Each pair of the movable contacts 15 are provided on a movable contact arm 16, and each of the fixed contacts 17 is provided on a fixed contact arm 18. The movable contact arm 16 is slidably held by the crossbar 10 and is urged by a compression spring 14 in order to give a contacting pressure to the movable contact 15. The fixed contacts 17 and the fixed contact arms 18 are built in a cover 20, and the crossbar 10 with the movable contacts 15 is slidably mounted within the cover 20. These components mounted within the cover 20 constitute a contact part B against the electromagnet part A. The cover 20 couples with the case 30, thereby forming an exterior part of the electromagnetic contactor. The contact part B is isolated from the electromagnet part A by a shielding sheet 40 made of a flat insulation board e.g. of a synthetic resin. The crossbar 10 is urged from the cover 20 to move rightward by a compression spring 50.

Figure 2A:
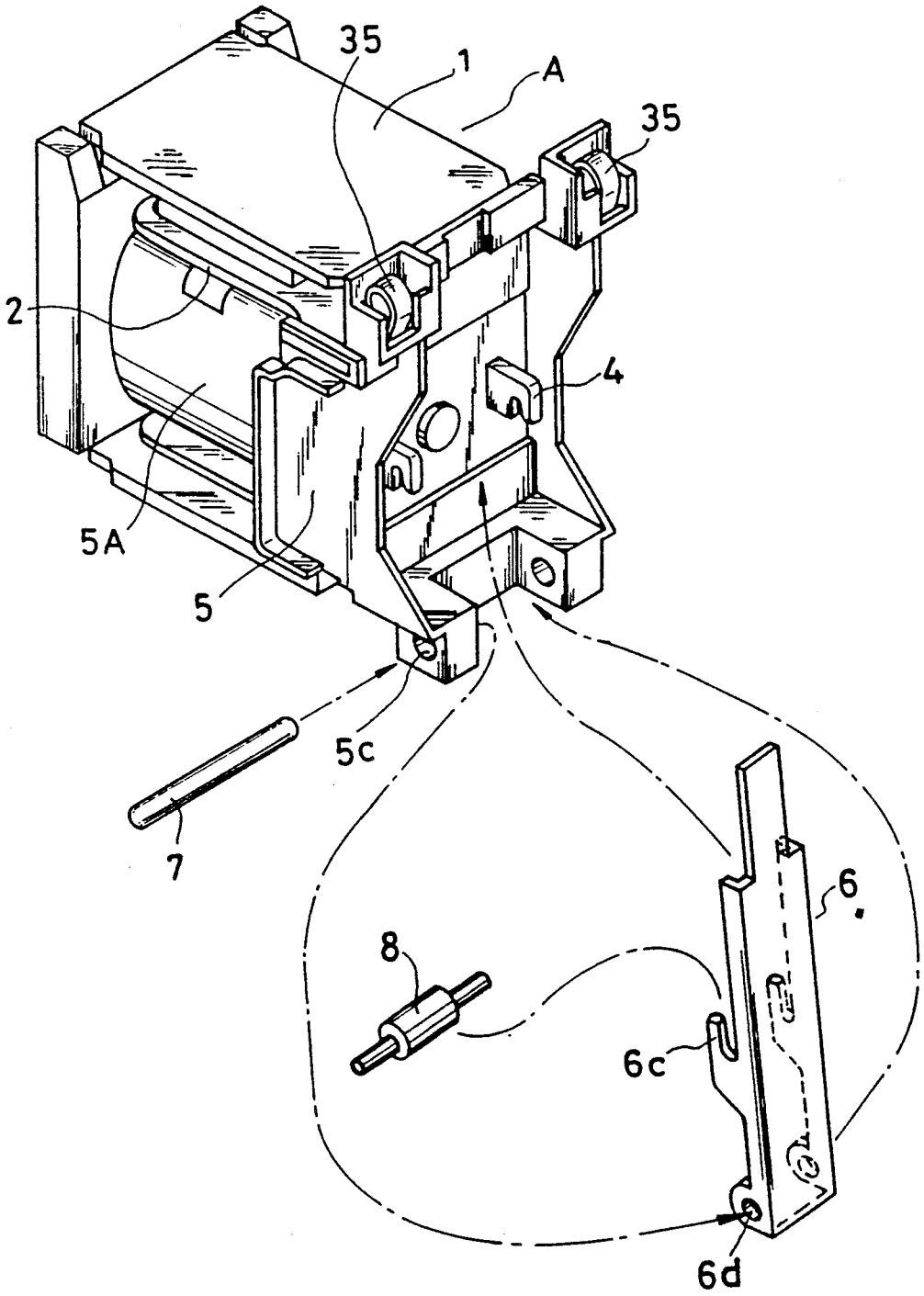
FIG. 2*a* is a perspective view showing an electromagnet part A in FIG. 1 and an assembling procedure of the link 6 thereto.
Figure 2B:
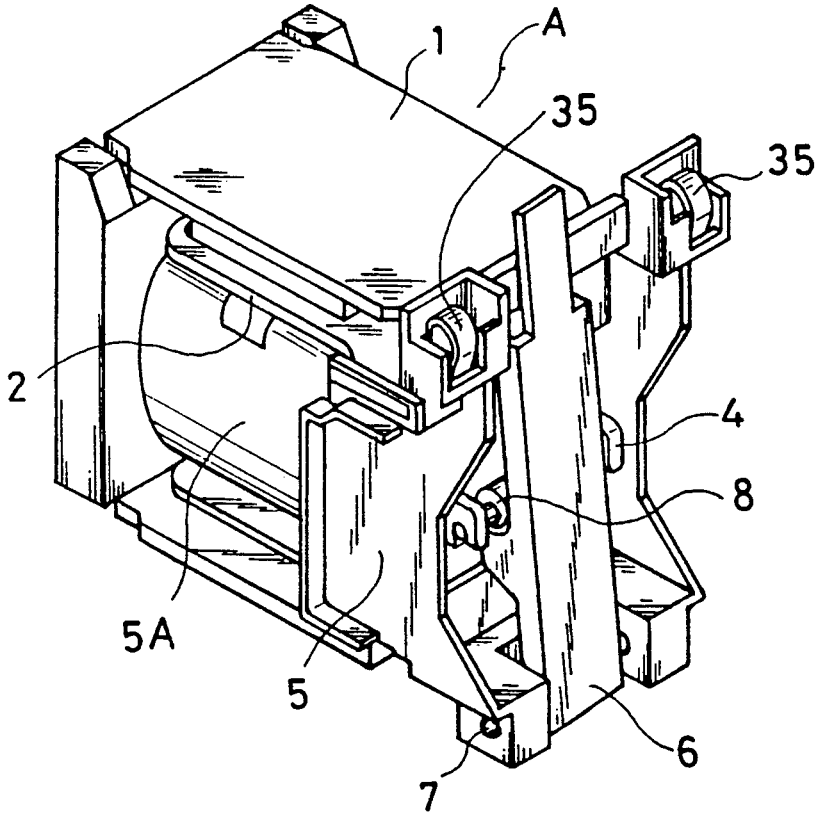
FIG. 2*b* is a perspective view showing the electromagnet part A after completion of assembly.

FIG. 2*a* is a perspective view showing the electromagnet part A and an assembling procedure of the link 6 thereto. The fulcrum pin 7 is inserted into holes 5*c* of the coil spool 5 and holes 6*d* of the link 6, thereby to pivotally hold the link 6. The fixed iron core 1 and the magnetic pole sheet 2 are tightly fit onto the coil spool 5. FIG. 2*b* is a perspective view showing the electromagnet part A after completion of assembly. The electromagnet part A is thus integrated into one unit body.

Next, operation of the above-mentioned electromagnetic contactor is described. A state shown by FIG. 1 is a released state of the electromagnetic contactor. When the coil 5A is excited from the released state, the movable iron core 4 is attracted to the fixed iron core 1 in a direction shown by an arrow X1. The crossbar 10 is thereby pushed leftward via the link 6 and makes sliding motion in a direction shown by an arrow X2. At that time, the movable contacts 15 make contact with the fixed contacts 17, thereby electrically making contact. When excitation of the coil 5A is lost, the crossbar 10 is pushed rightward by an expansion force of the compression spring 50 and returns to the released state. At that time, the movable contacts 15 detach from the fixed contacts 17, thereby electrically breaking contact. In breaking contact, arcs are generated between the fixed contacts 17 and the movable contacts 15.

Figure 3B:
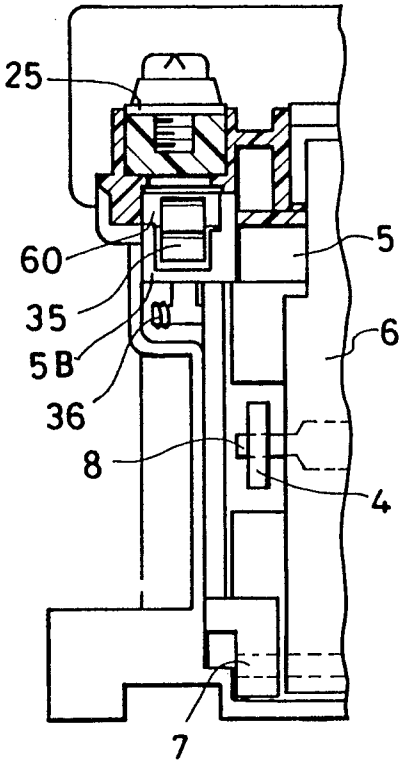
FIG. 3*b* is an internal side view of FIG. 3*a*.
Figure 3A:
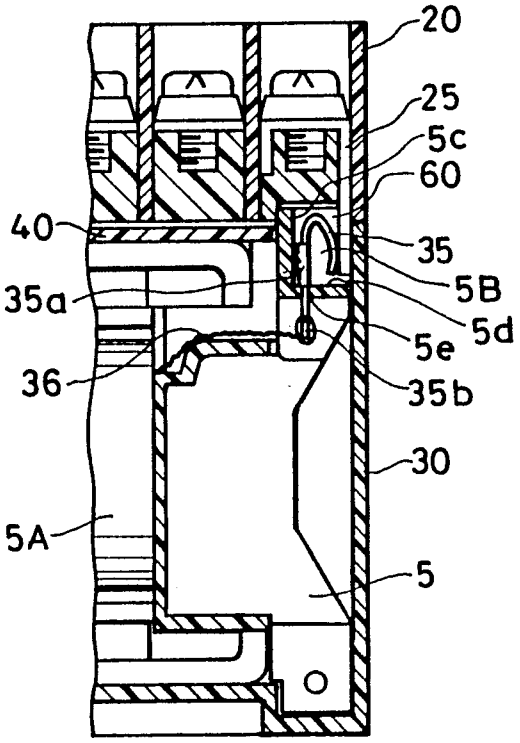
FIG. 3*a* is a partial cross-sectional view showing the electromagnetic contactor.
Figure 4A:
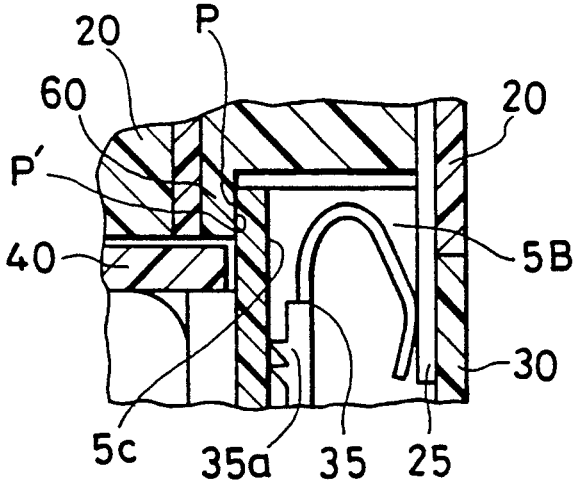
FIG. 4*a* is a partially enlarged view around a contact terminal 35 of FIG. 3*a*.

FIG. 3*a* is a partial cross-sectional view of the electromagnetic contactor, and FIG. 3*b* is an internal side view of FIG. 3*a*. FIG. 4*a* is a partially enlarged view around the contact terminal 35 of FIG. 3*a*. In these figures, the contact terminal 35, which is made of a thin metal sheet having an elasticity, makes contact with a coil terminal 25 (FIG. 3*a*), at mounting of the cover 20 onto the case 30, with a contact pressure by a spring force of itself. A lead wire 36 of the coil 5A is electrically connected to an end portion 35*b* of the contact terminal 35. An excitation voltage is supplied to the coil 5A from the coil terminal(s) 25 to which external wirings (not shown) are connected.

Figure 4B:
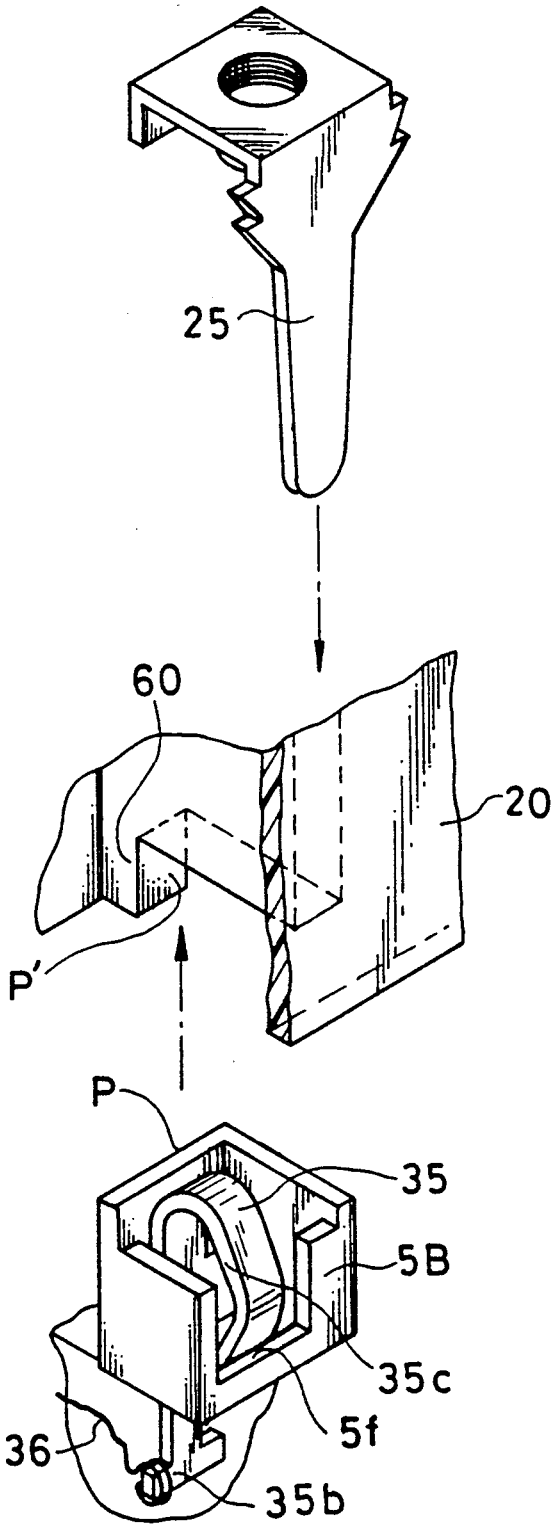
FIG. 4*b* is a perspective view showing a coupling procedure of a coil terminal 25 with the contact terminal 35 of the present invention.
Figure 4C:
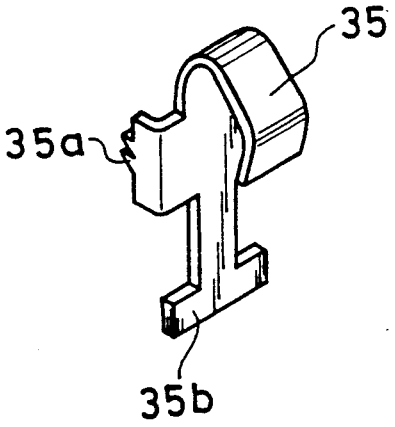
FIG. 4*c* is a perspective view showing the contact terminal 35 of the present invention.

FIG. 4*b* is a perspective view showing a coupling procedure of the coil terminal 25 with the contact terminal 35. The coil terminal 25 is tightly inserted between the cover 20 and an engaging member 60 which is a part of the cover 20. When the cover 20 is coupled with the case 30 (FIG. 1), the engaging member 60 is engaged with a box-shaped contact housing 5B which is a part of the coil spool 5. That is, a reference surface P of the contact housing 5B abuts against a reference surface P′ of the engaging member 60. FIG. 4*c* is a perspective view showing the contact terminal 35. The contact terminal 35 has a pair of stopper portions 35*a*, a spring portion 35*c* and the aforementioned end portion 35*b*. The contact terminal 35 has been pushingly inserted in the contact housing 5B (FIG. 4*b*) from the top. As shown in FIG. 3*a*, the end portion 35*b*, to which the lead wire 36 is connected, is projected downward out of the contact housing 5B through a hole 5*e* formed in a bottom part 5*d*, and the stopper portions 35*a* abut on the bottom part 5*d*. In FIG. 4*b*, a lower end part of the spring portion 35*c* is engaged with a cut-off part 5*f*, thereby settling itself in an initial position of the contact terminal 35 in the contact housing 5B to accept insertion of the coil terminal 25. In FIG. 4*a*, the stopper portions 35*a* also abut against a rear wall part 5*c* of the contact housing 5B. Therefore, the reference surfaces P and P′ abut against each other by a restoration force of the contact terminal 35 which is contracted by an insertion of the coil terminal 25 between itself and the case 30. Consequently, the contact housing 5B, hence the coil spool 5, is always pushed onto the reference surface P′ of the cover 20.

Figure 5:
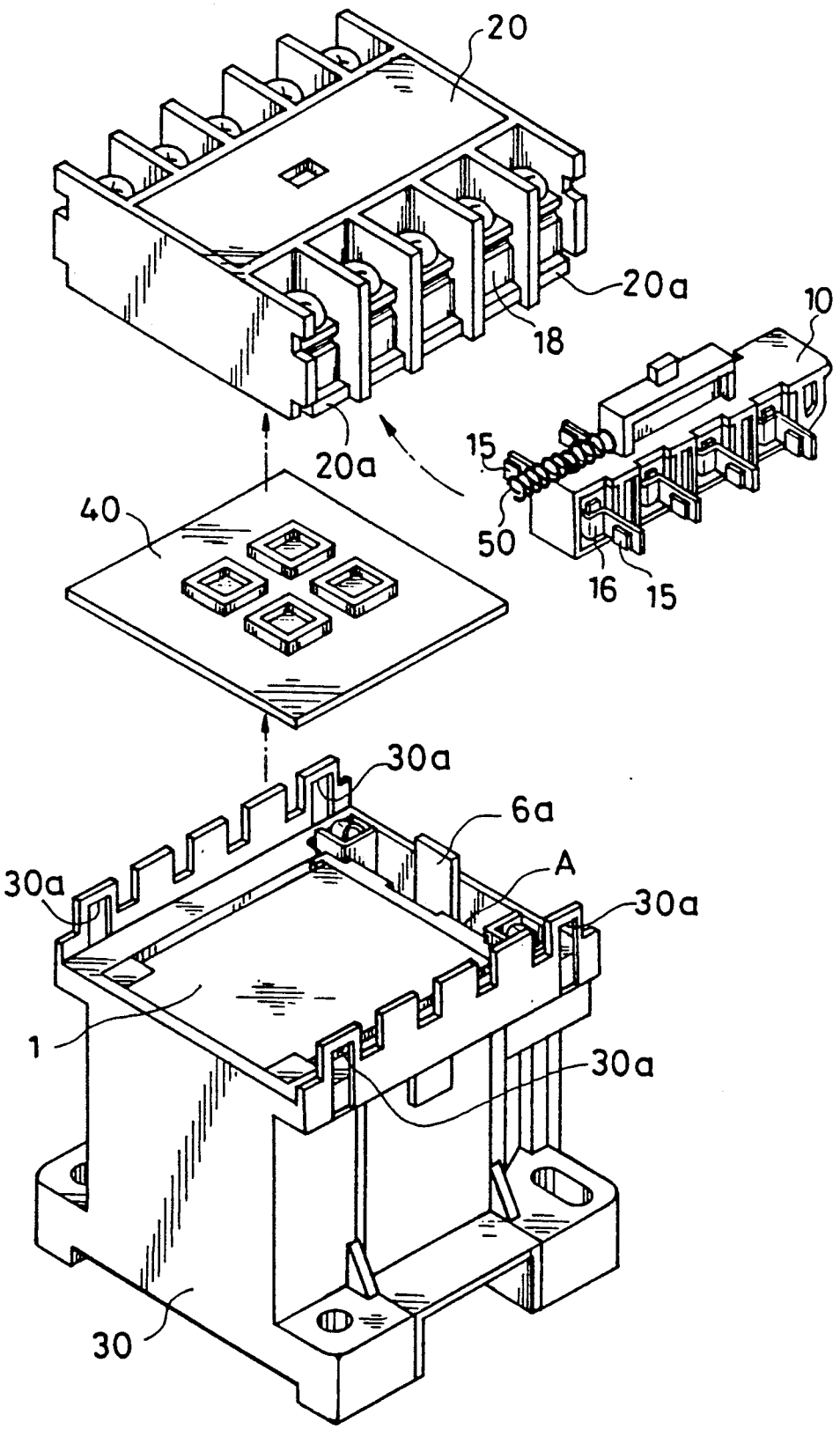
FIG. 5 is a perspective view showing main parts of the electromagnetic contactor of the present invention at an assembling stage.
Figure 6:
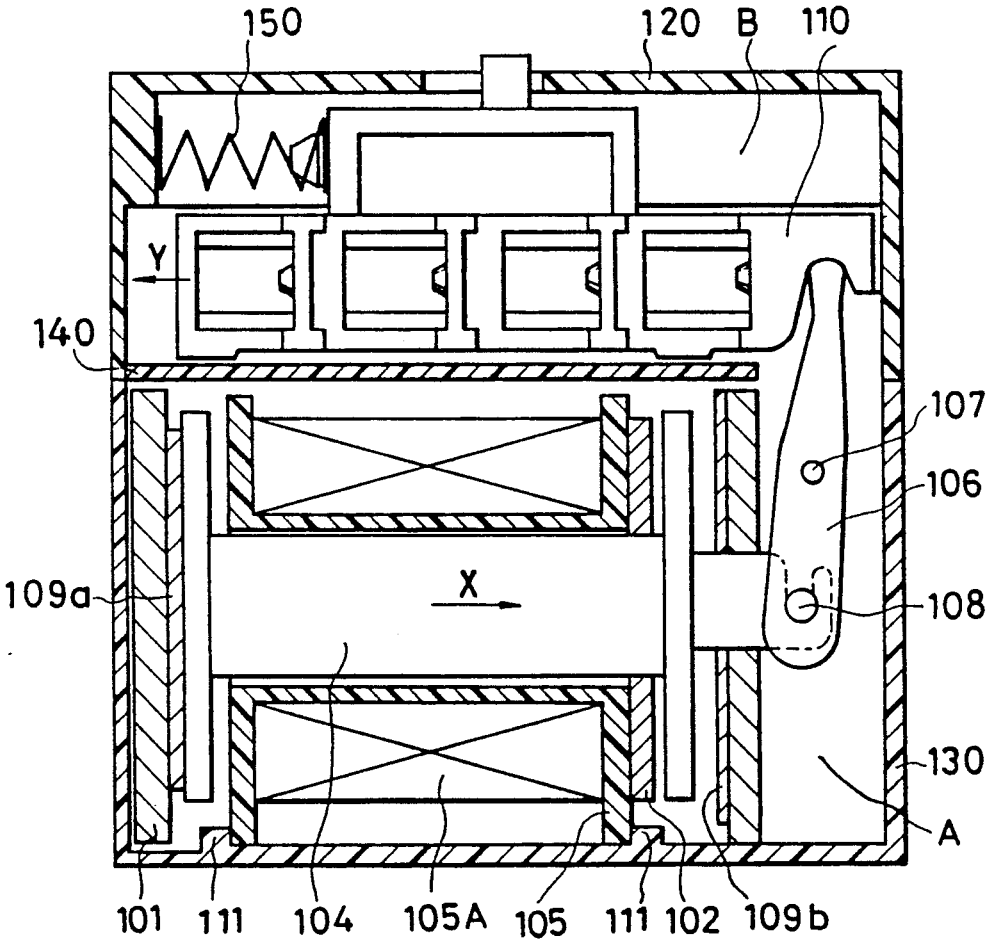
FIG.6 (Prior Art)
FIG. 6 is a cross-sectional view showing the conventional electromagnetic contactor.

FIG. 5 is a perspective view showing the cover 20, the shielding sheet 40, the crossbar 10 and the case 30 including the electromagnet part A. An assembling procedure of the electromagnetic contactor is described. First, the shielding sheet 40 is put on the fixed iron core 1. Second, the crossbar 10 provided with the movable contacts 15 etc. is inserted in the cover 20 from its lower part. Finally, the cover 20 including the crossbar 10 is mounted onto the case 30. When the cover 20 is mounted onto the case 30, four projections 20*a* formed at the bottom-corner portions of the cover 20 are engaged with four holes 30*a* formed in the upper-corner portions of the case 30, thereby coupling the cover 20 with the case 30. Since positioning of the cover 20 against the coil spool 5 is carried out by making contact of the reference surface P with the reference surface P′, positional relation between the cover 20 and the electromagnet part A is determined independent of the engagement of the cover 20 with the case 30. A position of the crossbar 10 is determined by the link 6, which is pivotally held by the coil spool 5, and is therefore independent of the case 30. As a result, the fixed contacts 17 fixed in the cover 20 is positioned by the coil spool 5, and the movable contacts 15 held by the crossbar 10 is driven by the link 6 pivotally held by the coil spool 5. Therefore, both positions of the fixed contacts 17 and the movable contacts 15 are not influenced by the integration of errors of the case 30 and the cover 20.

In the above-mentioned embodiment, since the box-shaped contact housing 5B is used as a contacting part of the coil spool 5 with the reference surface P′ of the cover 20, mechanical strength is sufficient to withstand the restoration force of the contact terminal 35. Further, when a thick metal (conductive) plate having a certain rigidity is employed as the coil terminal 25, the restoration force of the contact terminal 35 can be received only by the reference surface P′ and the coil terminal 25. When the coil terminal 25 is of thin plate, the restoration force is received by the reference surface P′ and the coil terminal 25 together with the cover 20 and the case 30.

Although an outer surface of the contact housing 5B is adopted as the reference surface P which is for making contact with the other reference surface P′ of the cover 20, another surface which is perpendicular to the moving direction of the crossbar 10 can be used similarly. The spring force given to the coil spool 5 against the coil terminal 25 can be supplied by a tension force in place of the restoration force like the contact terminal 35 of the above-mentioned embodiment.

Although the invention has been described in its preferred form with a certain degree of particularity, it is understood that the present disclosure of the preferred form has been changed in the details of construction and the combination and arrangement of parts may be restored to without departing from the spirit and the scope of the invention as hereinafter claimed.

What is claimed is:

1. An electromagnetic contactor comprising:

a coil spool in which a movable iron core is movably mounted and in which a coil is wound;

a cover in which a fixed contact is fixedly mounted and in which a crossbar having a movable contact is slidably mounted;

a mechanical link which is pivotally held by said coil spool and which mechanically links said movable iron core with said crossbar;

an engaging portion of said cover, said engaging portion being in engagement with said coil spool;

a coil terminal which is fixedly mounted in said cover and which includes an end part; and a contact terminal which has an elastic portion and which forms an electrical connection between said coil terminal and said coil by contact between said elastic portion and said end part, said contact between said elastic portion and said end part biasing said engaging portion into engagement with said coil spool.

2. An electromagnetic contactor in accordance with claim 1, wherein said elastic portion of said contact terminal is engaged with said coil spool at a position near a position where said elastic portion makes contact with said end part of said coil terminal.

3. An electromagnetic contactor in accordance with claim 2, wherein said elastic portion is mounted in a box-shaped housing of said coil spool.

4. An electromagnetic contactor in accordance with claim 3, wherein said housing is in engagement with said engaging portion.

5. An electromagnetic contactor in accordance with claim 3, wherein a cut-off part is formed in said housing at a position where said contact terminal makes contact with said end part of said coil terminal.

6. An electromagnetic contactor in accordance with claim 1, further comprising a case in which said coil spool is mounted, said case being coupled with said cover.

7. An electromagnetic contactor in accordance with claim 6, wherein a biasing force applied to said coil terminal by said elastic portion of said contact terminal is transmitted to said cover via said coil terminal.

8. An electromagnetic contactor comprising:

a movable iron core;

a coil spool in which said movable iron core is movably mounted and in which a coil is wound;

a mechanical link which is pivotally held by said coil spool and which is mechanically linked with said movable iron core;

a case in which said movable iron core, said coil spool and said mechanical link are mounted to constitute an electromagnet unit;

a crossbar which has a movable contact and which is positioned by said mechanical link;

a cover in which a fixed contact is fixedly mounted and in which said crossbar is slidably mounted to move said movable contact into and out of contact with said fixed contact;

a coil terminal on said cover; and a contact terminal, one end part of which is electrically connected to said coil and the other end part of which contacts an end of said coil terminal, said contact terminal having an elastic portion for biasingly holding a reference surface of said cover in engagement with said coil spool.

* * * * *